US006600098B2

(12) United States Patent
Mizuno et al.

(10) Patent No.: US 6,600,098 B2
(45) Date of Patent: Jul. 29, 2003

(54) MUSIC PERFORMANCE INFORMATION CONVERTING METHOD WITH MODIFICATION OF TIMBRE FOR EMULATION

(75) Inventors: Shigehiko Mizuno, Hamamatsu (JP); Hiroyuki Masuda, Kawasaki (JP)

(73) Assignee: Yamaha Corporation, Hamamatsu (JP)

( * ) Notice: Subject to any disclaimer, the term of this patent is extended or adjusted under 35 U.S.C. 154(b) by 119 days.

(21) Appl. No.: 09/951,301

(22) Filed: Sep. 10, 2001

(65) Prior Publication Data

US 2002/0046899 A1 Apr. 25, 2002

(30) Foreign Application Priority Data

Sep. 12, 2000 (JP) ..... 2000-276750

(51) Int. Cl.[7] ..... G10H 1/06; G10H 7/00
(52) U.S. Cl. ..... 84/622; 84/645
(58) Field of Search ..... 84/622, 659, 645

(56) References Cited

U.S. PATENT DOCUMENTS 5,554,814 A * 9/1996 Nakata ..... 84/659
5,563,359 A * 10/1996 Okamura ..... 84/600
5,831,192 A * 11/1998 Watari et al. ..... 84/600
5,864,081 A * 1/1999 Iwase et al. ..... 84/622
5,892,171 A * 4/1999 Ide ..... 84/622
6,518,491 B2 * 2/2003 Kurakake et al. ..... 84/610
6,525,256 B2 * 2/2003 Boudet et al. ..... 84/645

* cited by examiner

*Primary Examiner*—Jeffrey Donels
(74) *Attorney, Agent, or Firm*—Morrison & Foerster LLP

(57) ABSTRACT

A method of converting performance information is carried out by the steps of receiving identification information that identifies an target tone generator different from an available tone generator, reading out first performance information that indicates a music performance in the form of a sequence of tones, and that includes timbre information specifying a timbre of the tones, and changing the timbre information included in the read first performance information based on the received identification information so as to generate second performance information including the changed timbre information adapted to the target tone generator. By such a manner, the available tone generator can process the second performance information to generate the sequence of tones having a timbre as if generated by the target tone generator.

9 Claims, 7 Drawing Sheets

FIG.3(a)

| BANK | MSB | 01～3F | | | | |
|---|---|---|---|---|---|---|
| | LSB | 0 | 1 | 2 | ・・・ | 127 |
| Type | | COMPANY N | COMPANY P | COMPANY K | | COMPANY S |
| Pch# | 1 | Piano | Piano | Trumpet | | Strings |
| | 2 | Organ | Violin | Organ | | Piano |
| | 3 | Guitar | Bass | Flute | | Sax |
| | : | | | | | |
| | 128 | Bass | Sax | Bass | | Guitar |

FIG.3(b)

| BANK | MSB | 01～3F | | | | |
|---|---|---|---|---|---|---|
| | LSB | 0 | 1 | 2 | ・・・ | 127 |
| Type | | BASIC TIMBRE | COMPANY N | COMPANY P | | COMPANY S |
| Pch# | 1 | Piano | Piano | Piano | | Piano |
| | 2 | Organ | Organ | | | |
| | 3 | Guitar | Guitar | | | Guitar |
| | 4 | Bass | Bass | Bass | | |
| | 5 | Violin | | Violin | | |
| | 6 | Sax | | Sax | | Sax |
| | : | | | | | |
| | 128 | Strings | | | | Strings |

FIG.3(c)

| BANK | MSB | 01～3F | | | | |
|---|---|---|---|---|---|---|
| | LSB | 0 | 1 | 2 | ・・・ | 127 |
| Type | | BASIC TIMBRE | TG-LSI Y | TG-LSI R | | TG-LSI K |
| Pch# | 1 | Piano | Piano | Piano | | Piano |
| | 2 | Organ | Organ | | | |
| | 3 | Guitar | Guitar | Guitar | | |
| | 4 | Bass | Bass | | | Bass |
| | 5 | Violin | | | | Violin |
| | 6 | Sax | | Sax | | Sax |
| | ⋮ | | | | | |
| | 128 | Strings | | Strings | | |

FIG.3(d)

| BANK | MSB | 01～3F | | | | |
|---|---|---|---|---|---|---|
| | LSB | 0 | 1 | 2 | ・・・ | 127 |
| Type | | BASIC TIMBRE | TG-LSI Y | TG-LSI R | | USER AREA |
| Pch# | 1 | Piano | Piano | Piano | | Piano |
| | 2 | Organ | Organ | | | Organ |
| | 3 | Guitar | Guitar | Guitar | | Guitar |
| | 4 | Bass | Bass | | | Bass |
| | 5 | Violin | | | | Violin |
| | 6 | Sax | | Sax | | Sax |
| | ⋮ | | | | | |
| | 128 | Strings | | Strings | | Strings |

CONFIGURATION OF TIMBRE DESIGNATION

MUSIC PERFORMANCE INFORMATION CONVERTING METHOD WITH MODIFICATION OF TIMBRE FOR EMULATION

BACKGROUND OF THE INVENTION

1. Field of the Invention

The present invention generally relates to a tone generator, a performance information converting method, a performance information converting apparatus and a machine-readable medium of programs for use in an apparatus capable of producing musical sounds such as an electronic musical instrument, a personal computer and amusement equipment. More particularly, the invention relates to a tone generator, a performance information converting method, a performance information converting apparatus and a machine-readable medium suitable for use in emulating the sound of a ringing melody or the like to be sounded from a potable information terminal set.

2. Prior Art

Many portable telephones and PDAs (Personal Digital Assistants) can play a piece of music as a ringing or alarm tone (ringing melody). In many cases, the ringing melody is created by sequencer software on a personal computer, and is generally written in an SMF (Standard MIDI file). After the completion of music the creation of performance information for the ringing melody, the SMF file of the performance information is converted into a music format supported by a portable telephone or the like and transferred to the portable telephone concerned or the like.

Further, ringing-melody distribution service is so offered that a user of a portable telephone can access a ringing-melody distribution server, and after selecting a desired ringing melody, the user can download the same for use as the ringing tone. Since the server generally charges the user for downloading of the ringing melody from the distribution server, there have been proposals for systems and methods capable of listening to samples of some selected ringing melodies before the user purchases. In this case, the user can download only the ringing melody that the user likes as a result of listening without being charged. It has also been proposed that listening to the sample ringing melodies be performed on a personal computer. To be more specific, the distribution server pre-stores music data (for example, SMF) that can be reproduced on a personal computer so that a user can download to the user's computer music data (SMF) corresponding to a ringing melody that the user selects for listening on the computer. Then, when the ringing melody is good, the user downloads the ringing melody from the distribution server.

However, reproduction of SMF files on a personal computer generally gives much better reproductive quality than that on a portable telephone, which makes it difficult for a user to have a proper evaluation of the ringing melody. Further, there are various types of tone generator chips mounted in portable telephones, and kinds of available timbres and the number of simultaneous sounded tones vary depending on the tone generator chip, which also makes it difficult to achieve a compatibility of music data.

Therefore, creation of a ringing melody for a portable telephone requires a user to transfer a certain amount of music data of the ringing melody to the target portable telephone, and listen to the same. Such an operation also needs to be done for each type of portable telephone. Thus the creation of performance information of a ringing melody becomes troublesome work.

It is assumed that the user accesses the ringing melody distribution service to listen to music data on user's personal computer, and when purchasing the music data, the user downloads the same to the portable telephone. In this case, however, the user might lose his or her interest in using the downloaded melody as the ringing tone, because the ringing tone will probably be very different in impression from that the user has listen to on the personal computer. It is wasteful for the user to be charged for the unusable ringing melody.

SUMMARY OF THE INVNETION

The present invention has been made in view of the above-mentioned problems. It is an object of the invention to provide a tone generator capable of reproducing music data on a personal computer with tones close in quality to those of a ringing melody actually played on a portable telephone set. It is another object of the present invention to provide a performance converting method, a performance converting apparatus and a machine-readable medium, which make it easy to create the music data to be reproduced by the tone generator.

In one aspect of the invention, a method of converting performance information comprises the steps of receiving identification information that identifies an target tone generator different from an available tone generator, reading out first performance information that indicates a music performance in the form of a sequence of tones, and that includes timbre information specifying a timbre of the tones, and changing the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

In a preferred form, the step of reading reads out the first performance information including the timbre information that contains basic timbre information indicative of a basic timbre of the tones and variational timbre information indicative of a variation of the basic timbre, and wherein the step of changing changes the variational timbre information so as to adapt the variation of the basic timbre to the target tone generator.

In another aspect of the invention, an apparatus for converting performance information comprises a receiving section that receives identification information identifying an target tone generator different from an available tone generator, a reading section that reads out first performance information indicating a music performance in the form of a sequence of tones, and including timbre information specifying a timbre of the tones, and a converting section that changes the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

In another aspect of the invention, a medium is provided for use in a performance information converter having a processor. The medium contains program instructions executable by the processor for causing the performance information converter to carry out a process comprising the steps of receiving identification information that identifies an target tone generator different from an available tone generator, reading out first performance information that indicates a music performance in the form of a sequence of tones, and that includes timbre information specifying a timbre of the tones, and changing the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

In another aspect of the invention, a tone generator apparatus comprises a first bank memory that stores general timbre data representing a general timbre of a music tone generated by an acoustic instrument, a second bank memory that stores specific timbre data simulating a synthetic timbre of a music tone generated by an internal tone generator of a portable information terminal device, and a sound engine operative when the second bank memory is selected for generating a music tone having the synthetic timbre based on the specific timbre data stored in the selected second bank so as to emulate the internal tone generator of the portable information terminal device.

In a preferred form, the second bank memory stores the specific timbre data representing a plurality of synthetic timbres in corresponding to a plurality of model types of the portable information terminal device. Otherwise, the second bank memory stores the specific timbre data representing a plurality of synthetic timbres corresponding to a plurality of model types of a tone generating IC chip that can be selectable integrated as the internal tone generator into the portable information terminal device. Preferably, the tone generator apparatus further comprises a writeable bank memory that can be written with additional specific timbre data simulating another synthetic timbre, which can be generated by an internal tone generator of a portable information terminal device, but which is not stored in the second bank memory. Preferably, the writeable bank memory stores the additional specific timbre data, which is downloaded from an external data server.

BRIEF DESCRIPTION OF THE DRAWINGS

FIGS. 3(*a*)–3(*d*) are tables showing structural examples of timbre banks in tone generators;

DESCRIPTION OF THE PREFERRED EMBODIMENTS

1. First Embodiment 1.1 Structure of the Embodiment 1.1.1 General Structure

Figure 1:
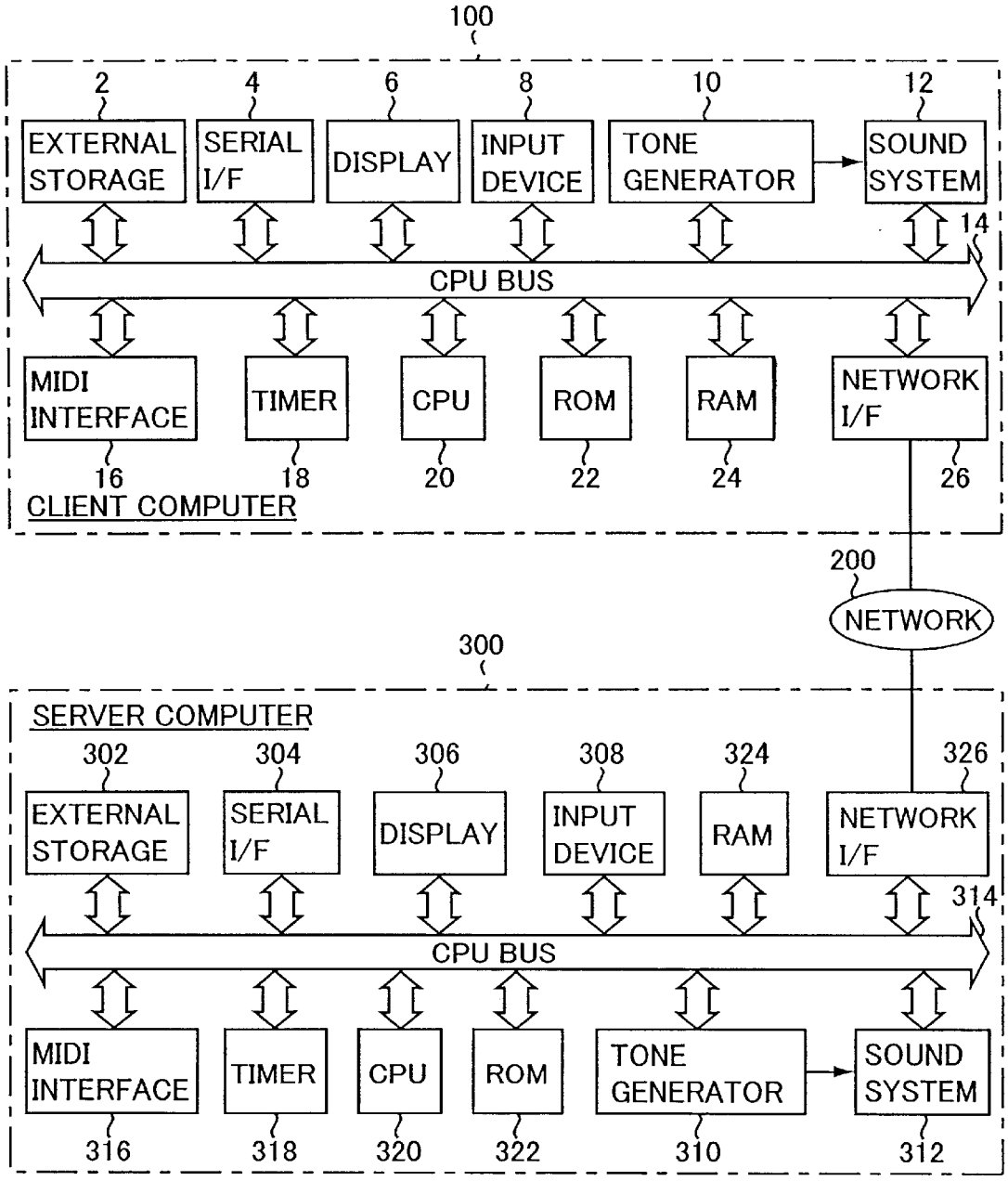
FIG. 1 is a block diagram of a performance information distribution system according to first to third embodiments of the present invention.

Referring to FIG. 1, description will be made about a hardware configuration of a performance information distribution system according to the first embodiment of the present invention. As shown, a client computer 100 and a server computer 300 are composed of a general-purpose personal computer and a server computer, respectively, connected to each other through a network 200 such as the Internet. An external storage 2 such as a hard disk is provided inside the client computer 100 for storing an operating system, an application program for a musical sound synthesizing system, wave data and other various kinds of data.

A serial interface 4 is connected to a portable telephone or the like; it carries out input and output control of various kinds of information to the portable telephone. A display 6 provides display of various kinds of information to a user. An input device 8 is composed of a computer keyboard, a mouse, an instrument keyboard and so on, by which the user inputs various kinds of information. A tone generator 10 generates a musical sound signal on the basis of performance information supplied. The musical sound signal generated is sounded through a sound system 12.

A MIDI interface 16 exchanges a MIDI signal with external MIDI equipment. A timer 18 causes an interrupt request at predetermined intervals. A CPU 20 controls each of components in the musical sound synthesizing system through a bus 14 on the basis of a control program to be described later. A ROM 22 stores an initial program loader and the like. A RAM 24 is used as a working memory for the CPU 20. A network interface 26 exchanges data with the server computer 300 through the network 200.

The server computer 300 has the same configuration as the client computer 100; it is provided with components 302 to 326 corresponding to the components 2 to 26 in the client computer 100. It should be noted that the components 304, 306, 308, 310, 312 and 316 are not necessarily provided, and they may be omitted from the server computer 300.

1.1.2. Timbre Mapping

Figure 4:
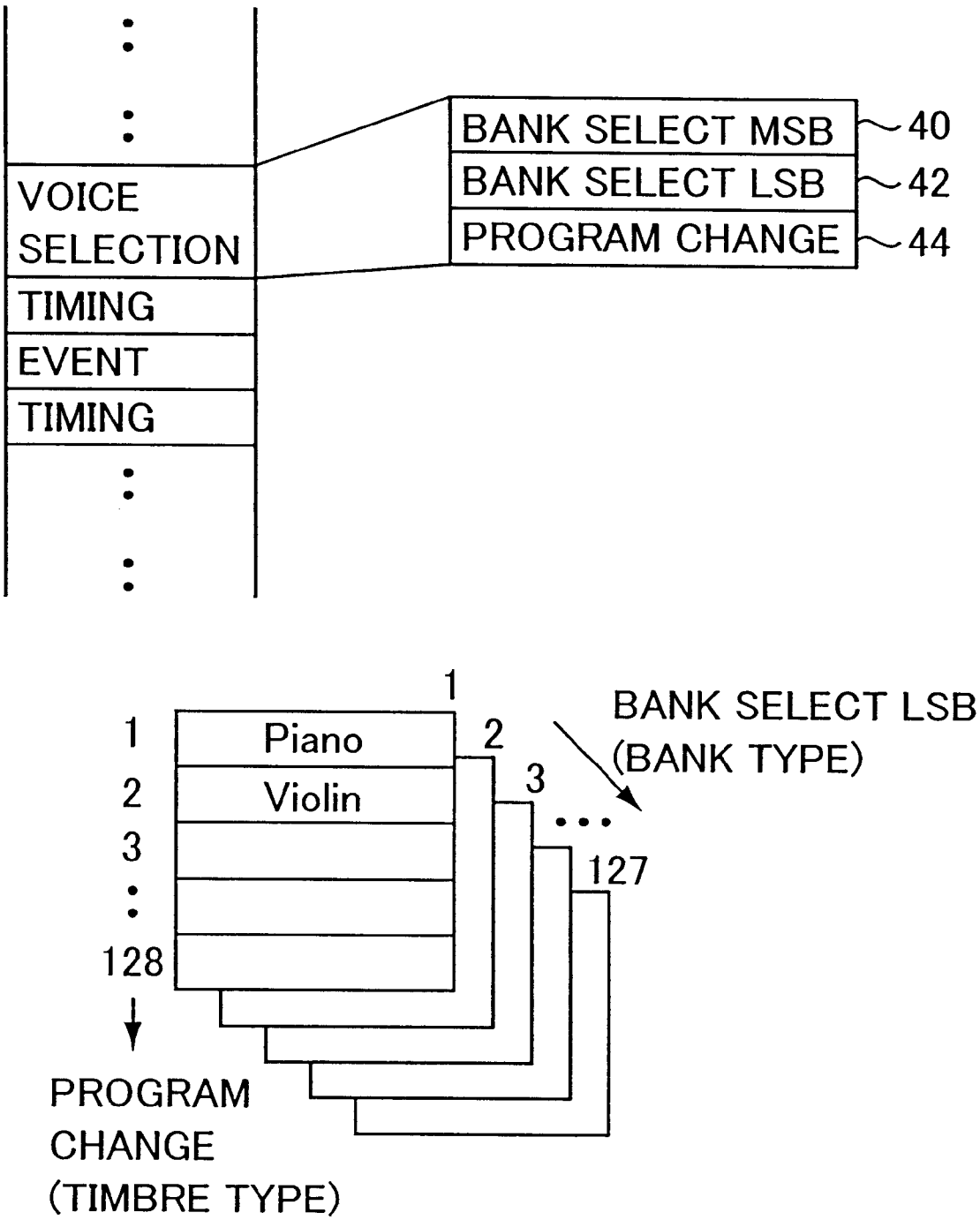
FIG. 4 is a diagram showing a timbre selecting method for use in a MIDI.

Referring next to FIG. 4, description will be made about timbre mapping in the tone generators 10 and 310. The tone generators 10 and 310 perform timbre mapping on the basis of XG standard (trademark). According to the XG standard, voice selection is defined by three kinds of data, each of which is made of one byte in length, namely a program change, a bank select MSB and a band select LSB. The program change data represent basic timbres. For example, a program change "1" represents the timbre of an "acoustic grand piano", and a program change "7 " represents the timbre of a "harpsichord."

The bank select MSB represents a classification of the timbre types, in which 0x00 (where "0x" represents a hexadecimal notation) indicates a melody timbre, 0x01 through 0x3F and 0x41 through 0x7D are undefined, 0x40 is an SFX timbre, 0x7E is an SFX kit, and 0x7F is a drum voice. The bank select LSB is designed such that 0x00 (where "0x" represents a hexadecimal notation) indicates a basic timbre, and 0x01 and the numbers that follows 0x01 indicate timbre variations. In the embodiment, one or more of the undecided bank select MSB (model-specific areas) are assigned to a bank of timbres that emulate composite tones of portable telephones. Thus the tone generators of the embodiment are composed of a bank of timbres that has emulated composite tones of the portable telephones and a bank of the other normal timbres.

FIG. 3(*a*) shows a set of timbres (set of parameters to be supplied to the tone generators) that emulate synthetic tones for portable telephones adopted by respective makers or for respective models of a maker. In FIG. 3(*a*), a set of timbres for each maker or each model is assigned to numbers "0" through "127" of the bank select LSB. The program change is so set that it corresponds to a timbre number unique to each portable telephone. In other words, the program change does not always match with a corresponding MIDI-compliant standard timbre. Therefore, even if program change numbers are identical to each other, they could be completely different in timbre depending on the maker or the model.

It should be noted that each maker is not limited to one model or one tone generator chip, and the maker may have two or more numbers of the bank select LSB corresponding to two or more models or two or more tone generator chips.

FIG. 3(*b*) shows a case where a set of basic timbres is assigned to number "0" of the bank select LSB, and sets of timbres that have emulated synthetic tones of respective potable telephones are assigned to the numbers "1" through "127" for each maker or model. In this example, a program change is assigned to a timbre of each portable telephone such that the timbre becomes similar to a corresponding basic timbre. If no timbre corresponding to the basic timbre exists in the timbre set, the timbre becomes undefined. In FIG. 3(*b*), columns corresponding to the undefined timbres are given a slash mark.

FIG. 3(*c*) shows a case where the set of basic timbres is assigned to the number "0" of the bank select LSB, and sets of variational timbres that have emulated synthetic tones of tone generator chips for use in various portable telephones are assigned to the numbers "1" through "127" of the bank select LSB. Likewise FIG. 3(*b*), a program change corresponding to each tone generator chip is so assigned that the timbre becomes similar to a corresponding basic timbre. If no timbre corresponding to the basic timbre exists in the timbre set, the program change becomes undefined.

FIG. 3(*d*) shows a case where a part of the bank select LSB (the number "127" in this example) is set as a user-definable area that allows for such a case that a new tone generator chip becomes available after timbre bank mapping is set. The user-definable area is made up of a rewritable memory such as a flash memory. If a new type of tone generator chip becomes available, a set of timbres for the new type of tone generator chip may be downloaded from the server computer 300 or obtained via a machine-readable medium. Then the downloaded or obtained timbre set is transferred to the user-definable area.

1.2. Schematic Functional Block Diagram of the Embodiment

Figure 6:
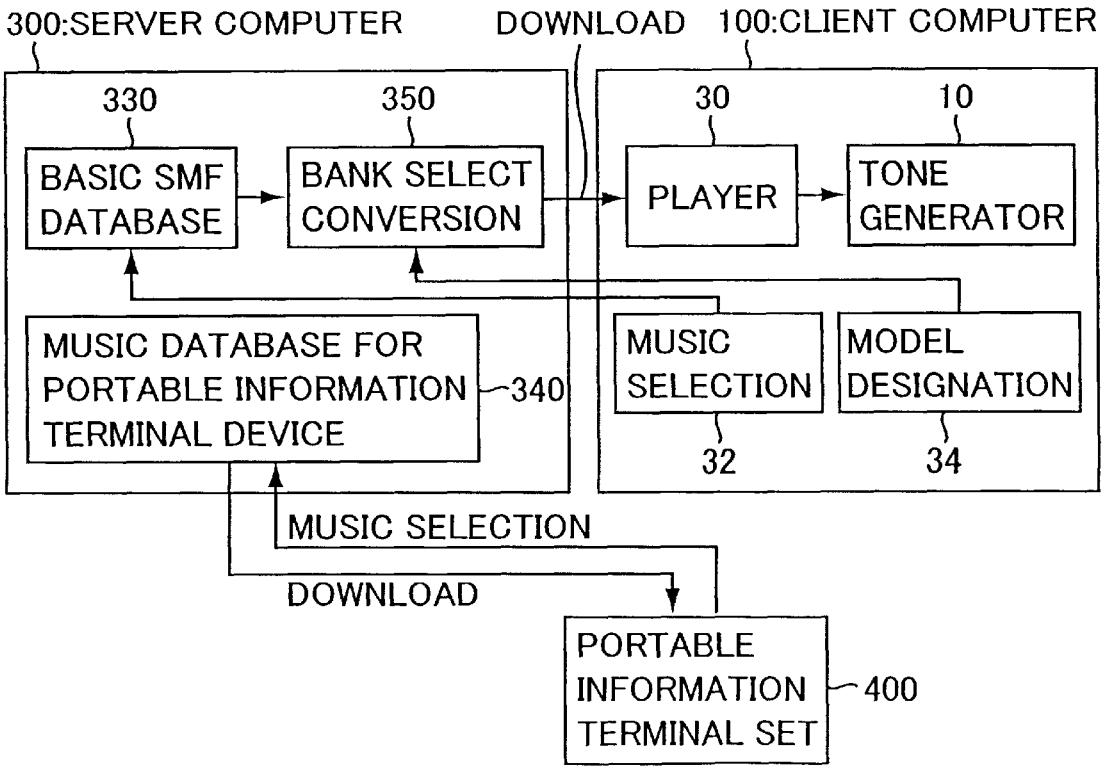
FIG. 6 is a schematic functional block diagram according to the first embodiment of the invention.

Referring next to FIG. 6, description will be made about schematic functional blocks of the inventive apparatus according to the embodiment. A downloadable music (basic SMF) database 330 and a database 340 specific to a portable information terminal sets are constructed in the external storage 302 such as a hard disk inside the server computer 300. The music database 340, stores music data corresponding to respective pieces of music on a terminal basis, A bank select conversion part 350 is also provided in the server computer 300. The server computer 300 sets up a Web page through the network so that any user can access the Web page at any time. The Web page carries a list of music pieces in the music database and a list of model names of portable information terminal sets. The bank select conversion part 350 can convert the mode/names into corresponding numbers of the bank select LSB. Thus the user can select a desired piece of music and a corresponding model name.

The client computer 100 includes a player part 30, the tone generator part 10, a music selection part 32 and a model designation part 34. The music selection part 32 selects the desired piece of music from the music list on the Web page, and transmits a music selection command to the server computer 300. The model designation part 34 specifies, from the list of the model names of portable information terminals on the Web page, the model of a portable information terminal 400 owned by the user. The user wants to listen to the timbre of the specified model. The model designation part 34 then transmits a model designation command to the server computer 300.

The corresponding piece of music (basic SMF) is read out from the basic SMF database 330 of the server computer 300 on the basis of the received music selection command. Then the bank select conversion part 350 writes into the SMF a program change including a bank select LSB corresponding to the model specified on the basis of the model designation command, and converts the SMF into an SMF format supported by the model specified. The SMF subjected to the bank select conversion is downloaded to the client computer 100 and reproduced in the player part 30 of the client computer 100 to supply corresponding MIDI data to the tone generator part 10. The tone generator part 10 generates tones on the basis of the MIDI data supplied from the player part 30. Since the MIDI data supplied here contain a program change having a bank select LSB corresponding to the type of the portable information terminal 400, the tone generator part 10 selects a bank of timbres that have emulated synthetic tones of the portable information terminal 400. This makes it possible to listen to a sample of the music with a timbre that has emulated the sound of the portable information terminal 400.

As a result of listening to the sample of the music piece, if the user purchases the music piece, the user uses the portable information terminal 400 to access the server computer 300. Then a command to select music data for the portable information terminal and corresponding to the music piece concerned is transmitted, and the selected music piece is downloaded. The downloaded music can be used as an alert tone (ringing melody) ringing at the time of arrival of a call or e-mail, an alarm tone or a BGM during talking. It can also be attached to an e-mail and transmitted to another portable information terminal.

Next, description will be made about processing executed by the bank select conversion part on the basis of a program recorded in the external storage 302 inside the server computer 300. The processing program is started in response to input of commands from the user, the commands indicating the music title and the model name of the portable information terminal, respectively. Then the processing program is executed in such a sequence as shown in the flowchart of FIG. 2.

Figure 2:
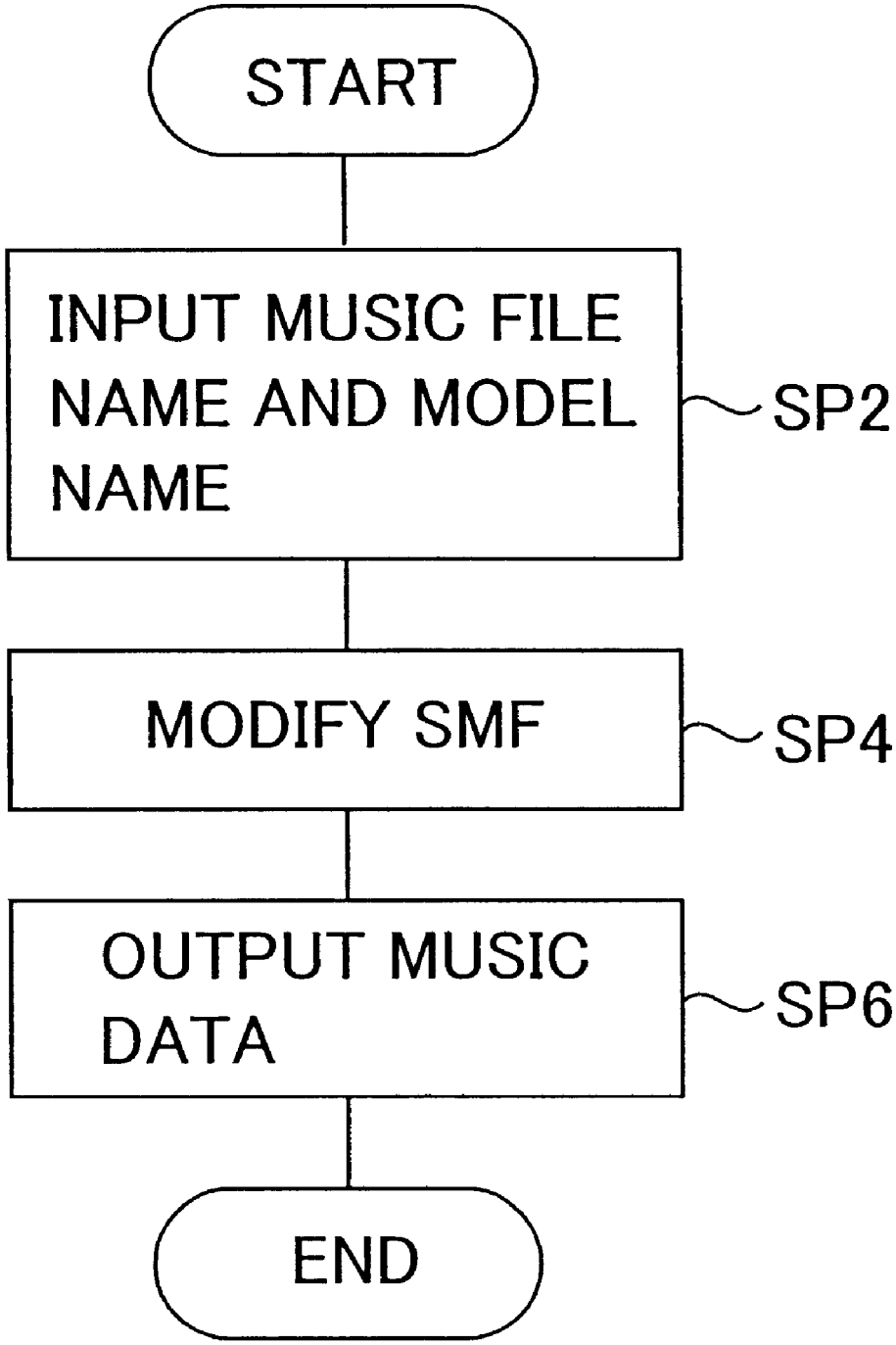
FIG. 2 is a flowchart showing processing executed on a server computer.

In FIG. 2, after the process is started, the processing procedure goes to step SP2 in which a model name and a music title (basic SMF file name) are read out from the Web page. The bank select LSB in the basic SMF file is originally set to "0" (that is, N company's portable terminal set in the example of FIG. 3(*a*), or the set of basic timbres in the examples of FIGS. 3(*b*) to 3(*d*)). Then the processing procedure goes to step SP4 in which the basic SMF file is read from the external storage 302 into a RAM 324, and converted into an SMF file according to the model name specified by the user.

Figure 5A:
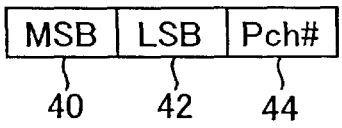
FIGS. 5(*a*)–5(*c*) are a diagram for explaining timbre conversion.
Figure 5B:
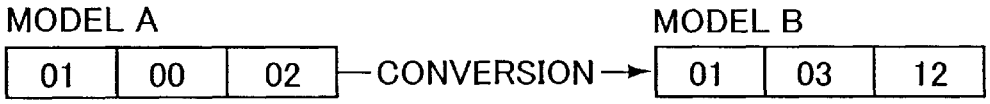
Figure 5C:
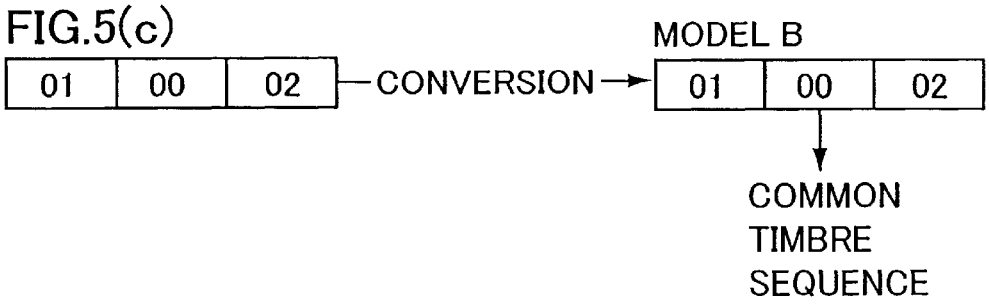

In other words, if mapping shown in FIG. 3(*a*) is adopted, a bank select LSB and a program change in the voice selection section within the SMF file are changed to numbers corresponding to the model name concerned. FIG. 5(*b*)

shows such a case. It is assumed that music data for basic model A (N company's portable terminal set in FIG. 3(*a*)) are prepared, in which "01" (one of the model-specific areas) is set as the bank select MSB, "00" (N company's portable terminal set) as the bank select LSB, and "02" (Organ) as the program change number. If the music data are converted into music data for a selected model B (for example, H company's portable terminal set, not shown in FIG. 3(*a*)), the bank select MSB is kept at "01" while the bank select LSB is changed to "03" (H company's portable) and the program change number is changed to "12" (Organ, not shown in FIG. 3(*a*)). Thus the music data for the model B is obtained. In this case, the correspondence between program change numbers (similar timbres) need to be stored separately for each individual model. If mapping shown in FIG. 3(*b*) is adopted, a bank select LSB in the voice selection section within the SMF file is changed to a number corresponding to the model name concerned. If the mapping shown in FIG. 3(*c*) or 3(*d*) is adopted, since a tone generator chip used is specified immediately after the model name of the portable telephone is specified, a bank select LSB in the voice selection section within the SMF file is changed to a number corresponding to the tone generator chip concerned. FIG. 5(*c*) shows cases of FIGS. 3(*b*) to 3(*d*).

It is assumed in FIG. 5(*c*) that general-purpose music data are prepared, in which "01" (one of the model-specific areas) is set as the bank select MSB, "00" (the set of basic timbres) is set as the bank select LSB, and "02" (Organ) is set as the program change number. If the music data is converted into music data for a selected model B (for example, N company's portable terminal set in FIG. 3(*b*) in which LSB is "01", or Y company's tone generator chip in FIGS. 3(*c*) and 3(*d*) in which LSB is "01"), the bank select MSB and the program change number are kept at "01" and "02" (Organ), respectively, while the bank select LSB is changed to "01" (N company's portable in FIG. 3(*b*) or Y company's tone generator chip in FIGS. 3(*c*) and 3(*d*)). Thus the music data adapted to the model B is obtained. In other words, if timbres in each row are made common to each company's portable telephone model or each tone generator chip, only the bank select LSB is changed.

Then, the processing procedure goes to step SP6 in which the music data (SMF) subjected to bank select conversion are output (distributed) to the player part 30 of the client computer 100. After that, the processing routine is ended. Thus any user can download a music data file from the Web page and listen on the client computer to the music data with a timbre close to the sound of a portable information terminal owned by the user. Then, only when the user likes the music, a ringing melody data corresponding to the music will be downloaded to the portable information terminal.

When the SMF file is reproduced, an undefined program change number or numbers (as indicated by the slash mark in FIGS. 3(*b*), 3(*c*) and 3(*d*)) might be specified for the target portable information terminal device. In this case, the tone generator part 10 synthesizes corresponding tone signals on the basis of corresponding timbres in the set of basic timbres (bank select LSB=1), that is, the tone generator part 10 sounds substitute tones.

2. Second Embodiment

Figure 7:
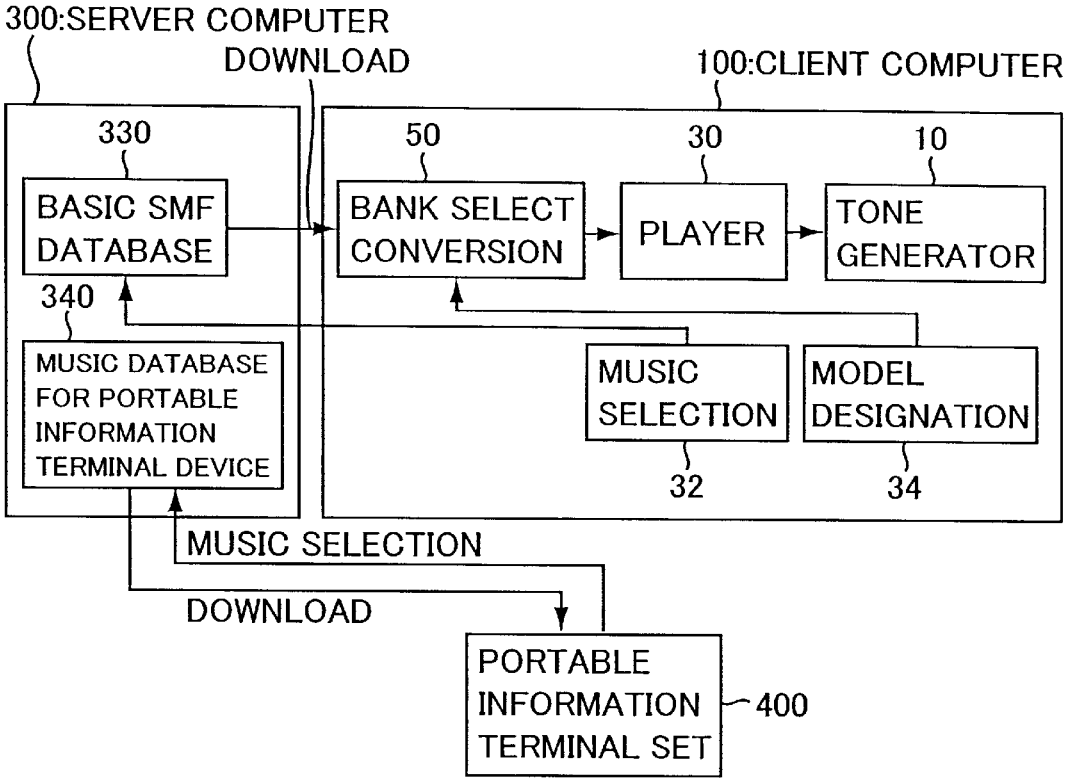
FIG. 7 is a schematic functional block diagram according to the second embodiment.

Next, the second embodiment will be described with reference to FIG. 7. In the above-mentioned first embodiment, the bank select conversion part 350 is provided on the server computer 300 side, and the client computer side downloads music data subjected to bank select conversion in response to input of the model designation command from the client computer 100. Unlike the first embodiment, the second embodiment limits the features of the server computer 300 to the function of providing SMF files alone as shown in FIG. 7. In other words, the second embodiment is designed such that the client computer 100 is provided with a bank select conversion part 50 in which the bank select conversion is performed for each model. In this case, the downloaded SMF file may be stored in the client computer as it is, so that when performance information is sent to the tone generator part 10, the contents of the bank select LSB and/or the program change are changed according to the type of the portable information terminal set, the sound of which is to be evaluated. This makes it possible to listen to a sample of music piece with one or more timbres corresponding to one or more models of portable information terminals. As a result, a user who owns one or more portable information terminals does not need to download the SMF separately for each portable information terminal set, or a user who plans to buy a new portable information terminal set can check the sound of the model of the new portable information terminal before purchasing.

3. Third Embodiment

Figure 8:
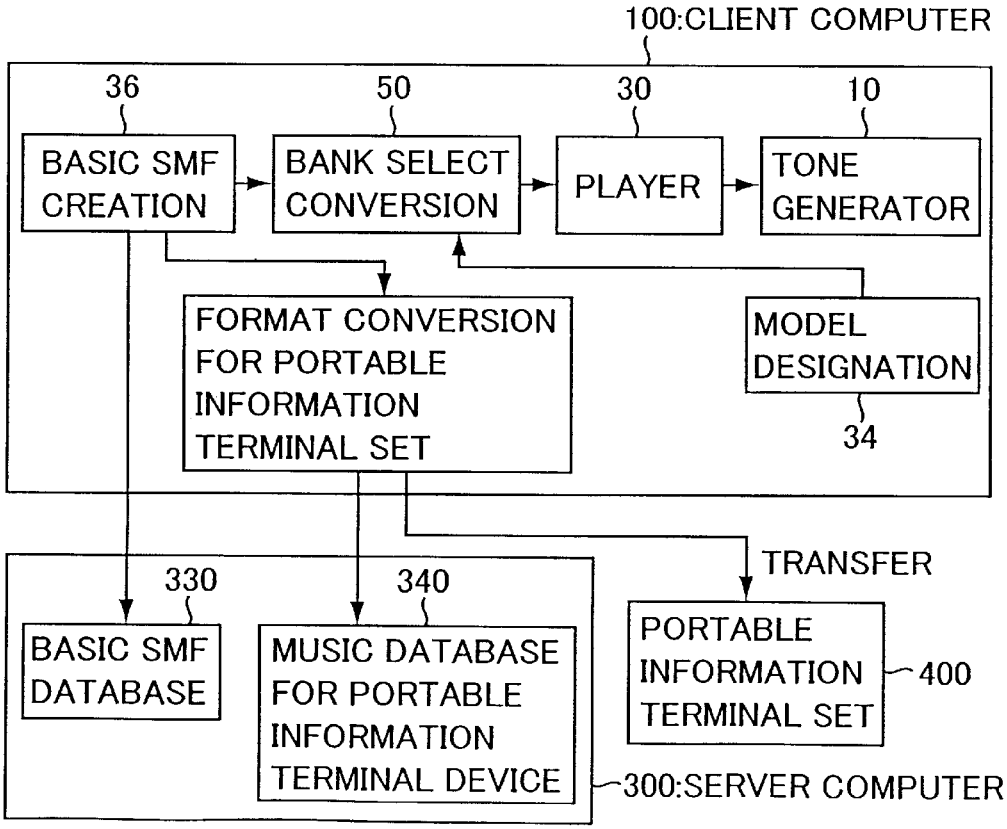
FIG. 8 is a schematic functional block diagram according to the third embodiment.

Next, the third embodiment will be described with reference to FIG. 8. The third embodiment is designed such that a user creates and listens to a new piece of music (SMF) on the client computer 100. Then the SMF is converted into a format supported by the portable information terminal set concerned. In the third embodiment, a basic SMF creation part 36, composed of a normal MIDI sequencer and the like, creates a basic SMF file. Likewise the above-mentioned second embodiment, the bank select conversion part 50 performs bank select conversion for each individual model according to the model specified by the model designation part 34. The SMF file subjected to bank select conversion is reproduced in the player part 30 and sounded by the tone generator part 10 as music tones that have emulated the timbre of the portable information terminal set concerned. As a result of listening, if the sound of the music is satisfactory, a portable information terminal-specific format conversion part 38 converts the basic SMF file into data adapted to the portable information terminal set concerned, and transfers the converted data to the portable information terminal set 400 through a serial interface.

It should be noted that when required, the created basic SMF may be uploaded to the basic SMF database 330 inside the server computer 300, or the music data for the portable information terminal set after the format conversion may be uploaded to the portable information terminal-specific music database 340 inside the sever computer 300. In such cases, any user of another client computer can audition the SMF or download the music data for the portable information terminal set concerned.

4. Effects of the Embodiments

The above-mentioned embodiments display the following effects.

(1) According to the above-mentioned embodiments, timbres that have emulated the sound of portable telephones are prepared for timbre banks of the tone generator 10, so that music can be played with a timbre similar to the sound of a specific portable telephone. Therefore, any user can listen to a sample of a ringing melody or the like on a personal computer without the need to transfer music data to the portable telephone, which makes it easy to evaluate the sample of the ringing melody or the like. The user can also listen to ringing tones of various portable telephones on the personal computer during the creation process of music data, which makes is possible to bring efficiency to the creation of music data.

(2) Further, in the above-mentioned embodiments, a portable telephone-specific timbre bank is provided for each model or each tone generator chip. Therefore, if timbres in a program change number are made common to each model or each tone generator chip as shown in FIGS. 3(*b*) to 3(*d*), the music data used by the model can be obtained merely by changing the bank (by rewriting the bank select LSB). Further, since there is provided the set of basic timbres (bank 0) that is not based on any specific model, even if some pieces of data are missing from the bank for each model, the basic timbre set can be used to sound substitute tones.

(3) Furthermore, in the above-mentioned embodiments, a general-purpose SMF file is prepared on the side of the server computer 300. The SMF file is changed on the basis of the model name or the tone generator chip specified by the user, and converted into a music data file corresponding to the model. Therefore, the SMF file as content data can be made common to each model, which makes them easy to manage the SMF file and to reduce the storage capacity required in the server computer 300.

5. Modifications

The present invention is not limited to the above-mentioned embodiments. For example, various modifications described below are possible.

(1) The above-mentioned embodiments show, as an example of the present invention, a performance information distribution system that distributes music data that have emulated the sound of a ringing melody generated from a portable telephone, but the present invention is not limited to the performance information distribution system. The present invention can also be applied to various portable information terminals and other apparatuses in which tone generators are mounted.

(2) In the above-mentioned embodiments, although timbre parameters are mapped to change the bank select LSB and like according to the sound of each portable telephone, effect parameters may also be mapped like the timbre parameters to switch banks so as to specify an effect according to the model.

(3) The above-mentioned embodiments implements the performance information distribution system via software, but the same feature may also be incorporated into various electronic musical instruments, sequencers and the like. Further, the software employed in the above-mentioned embodiments can be stored and distributed in the form of a machine-readable medium, such as a CD-ROM or a floppy disk, or through a transmission line.

(4) In the above-mentioned embodiments, the tone generators 10 and 310 are made of hardware tone generators, but they may be software tone generators that use CPUs 20 and 320 to synthesize musical sound signals, respectively. Further, any system such as a physical model type of tone generator, a waveform memory type of tone generator and an FM tone generator can be adopted as the sounding system of the tone generators 10 and 310. Furthermore, two or more sounding systems may be so provided that they can be used selectively according to the selected bank, or a sounding system that is different from that of a target portable telephone may be used. For example, musical sound signals output from a portable telephone using the FM tone generator may be sampled and emulated by the waveform memory type of tone generator.

(5) In the above-mentioned embodiments, music data are distributed from the server computer 300 to the client computer 100 through the network 200, but the music data may also be distributed in the form of a medium such as a CD-ROM.

(6) In the above-mentioned embodiments, the user-definable area is made up of a flash memory or the like, but it can also be realized by other techniques. For example, the user-definable area may be constituted of a memory chip removably mounted in the tone generator 10. In this case, the user-definable area can be made correspondent with a new model (or a new tone generator chip) by replacing the memory chip with another, which makes it easier to correlate the user-definable area with the new model (or the new tone generator chip).

(7) Timbre data may be extracted from the target portable telephone via a serial interface 4 so that the extracted data will be transferred to the user-definable area. In this case, the user-definable area can be made correspondent with the new model (or the new tone generator chip) without the need to provide a server computer outside.

(8) Further, in the above-mentioned embodiments, the tone generators 10 and 310 synthesize musical sound signals on the basis of a timbre provided in the set of basic timbres. However, if no timbre corresponds to the program change specified, the tone generators 10 and 310 may not sound tones on the basis of the set of basic timbres. For example, if the operation of a specific portable telephone or the like needs to be emulated accurately, it may be desirable not to sound tones incapable of being sounded by the portable telephone concerned.

(9) In the above-mentioned embodiments, the serial interface 4 is used to connect the potable terminal set, but any interface is applicable as long as it is connectable to the portable terminal set. For example, USB, a wireless connection by BlueTooth and the like are also applicable.

As described above, according to the present invention, timbre information contained in first performance information is changed on the basis of identification information to output second performance information that is adapted to the musical tone generating means, which makes is easy to create required performance information. Further, according to the present invention, the first and second timbre banks are provided, so that natural instrumental tones and synthetic tones that have emulated the sound of portable information terminals can be sounded.

What is claimed is:

1. A method of converting performance information comprising the steps of:

receiving identification information that identifies an target tone generator different from an available tone generator;

reading out first performance information that indicates a music performance in the form of a sequence of tones, and that includes timbre information specifying a timbre of the tones; and changing the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

2. The method according to claim 1, wherein the step of reading reads out the first performance information including the timbre information that contains basic timbre information indicative of a basic timbre of the tones and variational timbre information indicative of a variation of the basic timbre, and wherein the step of changing changes the variational timbre information so as to adapt the variation of the basic timbre to the target tone generator.

3. An apparatus for converting performance information comprising:

a receiving section that receives identification information identifying an target tone generator different from an available tone generator;

a reading section that reads out first performance information indicating a music performance in the form of a sequence of tones, and including timbre information specifying a timbre of the tones; and a converting section that changes the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

4. A medium for use in a performance information converter having a processor, the medium containing program instructions executable by the processor for causing the performance information converter to carry out a process comprising the steps of:

receiving identification information that identifies an target tone generator different from an available tone generator;

reading out first performance information that indicates a music performance in the form of a sequence of tones, and that includes timbre information specifying a timbre of the tones; and changing the timbre information included in the read first performance information based on the received identification information so as to generate second performance information including the changed timbre information adapted to the target tone generator, such that the available tone generator can process the second performance information to generate the sequence of tones having a timbre as if generated by the target tone generator.

5. A tone generator apparatus comprising:

a first bank memory that stores general timbre data representing a general timbre of a music tone generated by an acoustic instrument;

a second bank memory that stores specific timbre data simulating a synthetic timbre of a music tone generated by an internal tone generator of a portable information terminal device; and a sound engine operative when the second bank memory is selected for generating a music tone having the synthetic timbre based on the specific timbre data stored in the selected second bank so as to emulate the internal tone generator of the portable information terminal device.

6. The tone generator apparatus according to claim 5, wherein the second bank memory stores the specific timbre data representing a plurality of synthetic timbres in corresponding to a plurality of model types of the portable information terminal device.

7. The tone generator apparatus according to claim 5, wherein the second bank memory stores the specific timbre data representing a plurality of synthetic timbres corresponding to a plurality of model types of a tone generating IC chip that can be selectable integrated as the internal tone generator into the portable information terminal device.

8. The tone generator apparatus according to claim 5, further comprising a writeable bank memory that can be written with additional specific timbre data simulating another synthetic timbre, which can be generated by an internal tone generator of a portable information terminal device, but which is not stored in the second bank memory.

9. The tone generator apparatus according to claim 8, wherein the writeable bank memory stores the additional specific timbre data, which is downloaded from an external data server.

* * * * *